US005143633A

United States Patent [19]

Gallo et al.

[11] Patent Number: 5,143,633

[45] Date of Patent: Sep. 1, 1992

[54] OVERBASED ADDITIVES FOR LUBRICANT OILS CONTAINING A MOLYBDENUM COMPLEX, PROCESS FOR PREPARING THEM AND COMPOSITIONS CONTAINING THE SAID ADDITIVES

[75] Inventors: Roger Gallo, La Salle; Pierre Hoornaert, St Pierre de Chandieu; Jean-Philippe Roman, Lyon, all of France

[73] Assignee: Societe Nationale Elf Aquitaine, Courbevoie, France

[21] Appl. No.: 539,856

[22] Filed: Jun. 18, 1990

[30] Foreign Application Priority Data

Jun. 19, 1989 [FR] France ..... 89 08095

[51] Int. Cl.[5] ..... C10M 125/10; C10M 139/00

[52] U.S. Cl. ..... 252/18; 252/32.7 E; 252/33; 252/36; 252/38; 252/39; 252/40; 252/41; 252/42.7

[58] Field of Search ..... 252/18, 32.7 E, 33, 252/36, 38, 39, 40, 41, 42.7

[56] References Cited

U.S. PATENT DOCUMENTS

| | | | |
|---|---|---|---|
| 3,223,625 | 12/1965 | Cyphers et al. | 252/18 |
| 3,277,002 | 10/1966 | Hunt et al. | 252/18 |
| 3,281,355 | 10/1966 | Cyphers et al. | 252/18 |
| 3,496,105 | 2/1970 | Le Suer | 252/18 |
| 3,541,014 | 11/1970 | Le Suer | 252/18 |
| 4,601,837 | 7/1986 | Valcho et al. | 252/18 |

*Primary Examiner*—Prince Willis, Jr.
*Assistant Examiner*—Jerry D. Johnson
*Attorney, Agent, or Firm*—Burgess, Ryan & Wayne

[57] ABSTRACT

This invention relates to superbasic additives for lubricant oils containing an organic molybdenum complex virtually insoluble in hydrocarbons. The complexes are formed with organic compounds such as amines, diamines, alkoxylated amines, glycols and polyols.

The additives according to the invention have antiwear, friction-reducing and antioxidant properties in the lubricant formulations.

36 Claims, No Drawings

OVERBASED ADDITIVES FOR LUBRICANT OILS CONTAINING A MOLYBDENUM COMPLEX, PROCESS FOR PREPARING THEM AND COMPOSITIONS CONTAINING THE SAID ADDITIVES

BACKGROUND OF THE INVENTION

1. Field of the Invention

This invention relates to overbased additives for lubricant oils containing an organic molybdenum complex virtually insoluble in hydrocarbons.

2. Description of the Invention

The overbased additives are alkali metal or alkaline earth metal salts of organic acids rendered overbased by carbonation with carbon dioxide. The term overbased is used to denote the excess of alkali metal or alkaline earth metal relative to the stoichiometric amount necessary to neutralize the organic acid used.

The structure of the overbased additives is that of a colloidal dispersion in which the micelles contain the alkali metal or alkaline earth metal carbonate formed during the carbonation. The micelles are stabilized by the alkali metal or alkaline earth metal salts of organic acids which have a detergent effect.

The salts of organic acids used in the overbased additives are in general the sulphonates, the salicylates or the sulphurized phenolates described, respectively, in the U.S. Pat No. 4,604,219, EP-A 279,493 and FR 2,305,494.

These overbased additives are usable, in particular, in the lubricants used in internal combustion engines of the "petrol" type or of the "diesel" type.

Owing to their detergent and dispersant effect, they prevent the formation of lakes and varnish and keep in dispersion the soots resulting from the incomplete combustion of the fuel.

Another important function of these additives is the neutralization of acid compounds, such as the organic acids formed by oxidation of the oil and the acids formed during the combustion of the sulphur-containing products introduced by the fuels.

This neutralization function is particularly appreciated when using fuels rich in sulphur, such as the heavy fuels used in marine engines.

It is known, moreover, to use molybdenum-containing additives as friction-reducing agents in lubricants. The earliest product used was molybdenum bisulphide in the form of a stable dispersion.

To avoid the operations of grinding molybdenum bisulphide and bringing it into a stable dispersion, it was proposed to use oil-soluble organic molybdenum compounds which can be incorporated directly in the lubricants.

Amongst the oil-soluble molybdenum compounds, the dithiocarbamates (EP-A 205,165) and the molybdenum complexes with oxazoline (U.S. Pat. No. 4,176,073) may be mentioned. The molybdenum complexes with the compounds containing a basic nitrogen resulting from succinimides, amides, phosphonamides or Mannich bases are used in the sulphurized form (U.S. Pat. Nos. 4,263,152, 4,369,119, 4,395,343).

Molybdenum-containing overbased additives are also known. The molybdenum is incorporated in the form of an inorganic compound while (U.S. Pat. No. 4,601,837) or after (U.S. Pat. No. 3,496,105) rendering overbased.

SUMMARY OF THE INVENTION

We have now found surprisingly, that it was possible to incorporate molybdenum derivatives virtually insoluble in hydrocarbons in the overbased additives, because these derivatives dissolve during the reaction for rendering superbasic.

We do not wish to be restricted by this explanation, but we suggest that the molybdenum derivative is incorporated in the micelles of the colloidal dispersion with the alkali metal or alkaline earth metal carbonate.

The incorporation of the molybdenum derivative in the micelle results in the formation of a single multifunctional additive having the properties of overbased additives and those of molybdenum derivatives. The advantage of this multifunctional additive compared with mixtures of overbased detergents and oil-soluble molybdenum derivatives lies in their higher stability and in the fact that there is no competition between the two additives for access to the metallic surface to be lubricated.

The additives according to the invention have antiwear, friction-reducing and antioxidant properties in the lubricant formulations.

This invention therefore relates to overbased additives for lubricant oils, made up of at least one detergent and an alkali metal or alkaline earth metal carbonate in a diluent oil, characterized in that they contain at least one organic molybdenum complex virtually insoluble in hydrocarbons.

DESCRIPTION OF THE PREFERRED EMBODIMENTS

Amongst the organic molybdenum complexes, the amine-molybdenum complexes are very particularly suitable.

The amine-molybdenum complexes are prepared by reaction of an inorganic molybdenum compound having an acid reaction with an amine.

Amongst these molybdenum compounds, molybdic acid, alkali metal molybdates, sodium hydrogen molybdate, ammonium molybdate, $MoOCl_4$, $MoO_2Br_2$, $Mo_2O_3Cl_6$ and molybdenum trioxide may be listed.

Sodium molybdate and ammonium molybdate are preferably used.

The amines used are of aliphatic or aromatic structure.

Amongst the aliphatic amines, the primary, secondary or tertiary amines are suitable with the proviso that they form, with molybdenum compounds, complexes which are virtually insoluble in hydrocarbons. The use of primary amines, the complexes of which with molybdenum are very sparingly soluble in hydrocarbons, is particularly recommended.

Amongst the primary amines, oleylamine, stearylamine, dodecylamine, tert-dodecylamine, 2-ethylhexylamine and cyclohexylamine will be mentioned.

The amine group can be attached to a primary carbon, as in the amines already mentioned, but also to a secondary or tertiary carbon, as in 1-amino-1,1-dimethyldecane and 1-amino-1,1-dimethyldodecane.

The use of certain secondary amines can be recommended. Thus, the secondary amines in which the total number of carbons does not exceed 12 in general give complexes with molybdenum which are insoluble in hydrocarbons.

Amongst the aromatic amines, para-dodecylaniline may be mentioned.

The use of diamines having a primary amine group is also recommended.

The diamines of the general formula $R_1R_2N—(CH_2)_n—NH_2$(I), where $R_1$ and $R_2$ are identical or different and represent hydrogen or a straight-chain or branched, saturated or unsaturated $C_1$ to $C_{30}$, and preferably $C_8$ to $C_{20}$, aliphatic radical, it being obligatory for one of the radicals $R_1$ or $R_2$ to represent an aliphatic radical and n being between 1 and 8 and preferably between 2 and 4, form complexes which are very sparingly soluble in hydrocarbons.

Some of the diamines of general formula (I) are marketed by the company CECA S.A. under the name DINORAM.

In the DINORAM series, $R_1$ represents hydrogen and $R_2$ saturated or unsaturated aliphatic radicals originating from fatty acids. These compounds are in general mixtures containing $C_{12}$ to $C_{18}$ alkyl radicals.

The amine-molybdenum complex is in general prepared in an aqueous medium. The amine is added to an aqueous solution of inorganic molybdenum compound.

The reaction mixture is kept at a temperature of between 20° and 100° C., preferably between 50° and 90° C., for 0.5 to 3 hours after the addition of the amine.

The amount of acid necessary to neutralize the reaction mixture is added before or after the introduction of the amine. A strong mineral acid is used, preferably sulphuric acid.

The amine-molybdenum complex precipitates. It is recovered by filtering off, washed with water and dried if appropriate.

The complex has a solid or pasty appearance, depending on the type of amine used. Its colour varies from white to blue. It is virtually insoluble or very sparingly soluble in hydrocarbons.

The atomic ratio of nitrogen to molybdenum in the complex is in general between 0.25 and 4 and preferably between 0.5 and 2.

The molybdenum content of the complex varies depending on the nature of the amine used: it is between about 10 and 45%.

Amongst the organic molybdenum complexes, the complexes with oxygen-containing compounds may also be mentioned.

The 1,2-, 1,3- and 1,4-glycols are very particularly suitable. Ethylene glycol and propylene glycol are preferably used.

Amongst the polyols, glycerol and trimethylolpropane may be mentioned.

Some amines, or polyamines which are alkoxylated, preferably with ethylene oxide or propylene oxide, are also suitable. The derivatives of diethanolamine or of triethanolamine may be mentioned.

The preparation of these complexes can be carried out by heating the oxygen-containing compound at 90°-100° C. in the presence of a molybdenum compound, such as ammonium molybdate. The water produced by the reaction is removed under a stream of nitrogen.

The molybdenum content of the complexes obtained varies between 7 and 50% by weight, depending on the degree to which unreacted oxygen-containing compound has been removed.

The organic molybdenum complex can be sulphurized, for example, by the action of hydrogen sulphide ($H_2S$) on a suspension of the complex in an aromatic solvent such as xylene or toluene, at a temperature of between 40° C. and 100° C. From the introduction of hydrogen sulphide, the colour of the suspension changes from blue-green to orange and then to red. The amount of hydrogen sulphide introduced is such that the atomic ratio of sulphur to molybdenum is between about 1 and 3.

The process for the preparation of overbased additives according to the invention consists in carbonation of a mixture containing a detergent or a detergent precursor, an alkali metal or alkaline earth metal derivative, a nitrogen-containing and/or oxygen-containing promoter, if appropriate a hydrocarbon solvent, a diluent oil and/or water, characterized in that the said mixture contains at least one organic molybdenum complex virtually insoluble in hydrocarbons.

Amongst the detergents which can be used within the framework of the invention, the alkali metal or alkaline earth metal sulphonates, phenolates, naphthenates, salicylates, phosphonates and thiophosphonates soluble in the hydrocarbon medium may be mentioned.

The sulphonic acids used for the preparation of the sulphonates can be of petroleum or synthetic origin. The petroleum sulphonic acids are prepared by sulphonation of oils obtained from the distillation of petroleum. Their structure does not correspond to a well-defined formula but their average molecular weight must be at least 300.

The synthetic sulphonic acids are prepared by alkylation of aromatic compounds such as benzene, toluene, xylene or naphthalene with olefin cuts followed by sulphonation of the alkylate obtained. The structure of the alkyl chains fixed on the ring is straight-chain or branched depending on the olefins used for the alkylation. The number of carbon atoms per alkyl chain is greater than or equal to 8.

The preparation of the alkali metal or alkaline earth metal sulphonate is carried out by bringing the sulphonic acid into contact with an alkali metal or alkaline earth metal derivative (preferably oxide or hydroxide) in a hydrocarbon solvent, if appropriate in the presence of an alcohol.

The alkali metal or alkaline earth metal phenolates are prepared under conditions which are analogous or essentially different in respect of the temperature, from alkylphenol or sulphurized alkylphenol. The phenol ring can carry one or two straight-chain or branched alkyl chains containing at least 8 carbon atoms. The most widely used compound is dodecylphenol.

The possible sulphurization of phenol is carried out by the action of sulphur monochloride $S_2Cl_2$ or by the action of elementary sulphur at temperatures ranging from 150° to 200° C. The sulphurized product contains about 1 to 1.5 sulphur atoms per phenol ring.

The alkylsalicylic acids are prepared by alkylation of salicylic acid or by carboxylation under pressure of alkylphenols. The alkyl chain contains a minimum of 12 carbon atoms.

The phosphonates and thiophosphonates are prepared by the action of $P_2O_5$ or $P_2S_5$ on a polyisobutene followed by neutralization by an alkali metal or alkaline earth metal oxide or hydroxide. The molecular weight of the polyisobutene is between 300 and 2000.

All of these detergents can be used in a mixture with dispersing agents soluble in a hydrocarbon medium, for example of the type of an alkylsuccinimide or esters of alkylsuccinic acids having a molecular weight of 300 to 2500.

Instead of the detergents, the reaction mixture can contain the precursors. In this case, the neutralization is carried out in the reaction mixture just before carbonation.

The alkali metal or alkaline earth metal derivatives can be the oxides, hydroxides or alcoholates. The preferred derivatives are the oxides and hydroxides.

The latter are added to the reaction mixture in a stoichiometric excess relative to the detergent or to its precursor. The stoichiometric excess can vary between 5:1 and 30:1.

In the process according to the invention, an oxygen-containing promoter, which is generally an aliphatic or aromatic alcohol, an alkoxyalkanol, a glycol or an alkanolamine, is introduced into the reaction mixture before carbonation. $C_1$ to $C_{20}$ aliphatic alcohols or their mixtures are preferably used. The aliphatic alcohols can be used as a mixture with glycols, alkoxyalkanols or alkanolamines.

The molar ratio of the oxygen-containing promoter to the detergent is generally between 1 and 30.

The use of a nitrogen-containing promoter is optional. This nitrogen-containing promoter is generally chosen from ammonia, ammonium salts, primary, secondary or tertiary $C_2$ to $C_{10}$ amines and their salts with carboxylic acids or boric acid, polyamines or alkanolamines.

Amongst the nitrogen-containing promoters, ammonia, ammonium carbonate and ammonium chloride, ethylenediamine, ethanolamine or diethanolamine are preferred.

The molar ratio of the promoter to the detergent is generally between 1 and 30.

The hydrocarbon solvent permits a perfect homogenization of the various reactants as well as a lowering of the viscosity which will subsequently facilitate the recovery of the solid carbonation residues. The solvent makes up 10 to 70% by weight of the reaction mixture. The solvents used are aliphatic or aromatic $C_6$ and $C_{12}$ compounds. The preferred solvents are aromatic solvents such as benzene, toluene, xylene, ethylbenzene and the chlorinated aromatic compounds. Their choice is dictated by the characteristics of the additive collected, by their boiling point and by the boiling point of azeotropes which they are able to form with the oxygen-containing promoters and water.

Handling of the molybdenum-containing overbased additive obtained according to the invention is facilitated by the addition of oil. The oil makes up about 20 to 50% by weight of the additive obtained. The oil can be added to the reaction mixture before the carbonation or thereafter, that is to say just before the removal of the solvent. The diluent oils used are of a paraffin character, of the type 100 or 150 neutral solvent, or of a predominantly naphthenic character, such as 100–150 pale solvent.

The carbonation reaction can be carried out after the addition, if appropriate, of water to the reaction mixture. The addition of water proves particularly beneficial if the alkali metal or alkaline earth metal derivative is an oxide. In general, the amount of water added is such that the molar ratio water/metal oxide is of the order of 0.5.

The implementation of the process according to the invention consists in the successive introduction of the following into a reactor fitted with a stirrer, a temperature control, a carbon dioxide gas bubbling device, a heating system and a system for applying vacuum:

0 to 700 parts by weight of a hydrocarbon solvent, 100 to 400 parts by weight of a detergent or of a detergent precursor an alkali metal or alkaline earth metal derivative in stoichiometric excess relative to the detergent or to its precursor; this stoichiometric excess is between 5:1 and 30:1 an oxygen-containing promoter, the molar ratio of which to the detergent or to its precursor is between 1 and 30 if appropriate, a nitrogen-containing promoter, the molar ratio of which to the detergent is between 1 and 30 if appropriate, an amount of water such that the water/metal oxide molar ratio is of the order of 0.5 if appropriate, diluent oil in an amount such that the latter makes up 20 to 50% by weight of the additive recovered at the end of the operations, and an organic molybdenum complex described above in an amount such that the molybdenum content of the finished product is between 0.1 and 10% by weight.

In the case where a detergent precursor is used, it is preferable successively to introduce the precursor, the molybdenum complex and finally the excess of alkali metal or alkaline earth metal derivative.

The neutralization of the detergent precursor is then carried out and this is followed by the carbonation of the stoichiometric excess of the alkali metal or alkaline earth metal derivative at a temperature of between ambient temperature and the reflux temperature of the mixture. The molar ratio of the $CO_2$ introduced to the stoichiometric excess of alkali metal or alkaline earth metal is between 0.6 and 1.2. If appropriate, the mixture is stabilized by heating under vacuum or under a stream of nitrogen so as to remove the oxygen-containing promoters moters of low boiling point and the water added, as well as the water produced by the carbonation. The solid residues are removed by centrifuging and/or filtering with the aid of diatomaceous earth. If the diluent oil has not been added before carbonation, it is then added before removal, if appropriate, of the hydrocarbon solvent and the heavy alcohols, by heating under vacuum at temperatures of the order of 100° to 200° C.

It should be pointed out that the filtration operation can be carried out after recovery of the solvent.

The overbased products containing molybdenum, obtained according to the invention, are clear and stable and coloured brown in the case of the sulphonates, deep green in the case of the phenolates and black in the case of the salicylates. The colour is generally red for the overbased detergents in the presence of a sulphurized complex.

The proportion of molybdenum incorporated in the additive is close to 100%, clearly higher than the proportions obtained during incorporation of inorganic molybdenum derivatives.

The additive contains between 0.1 and 10% by weight and preferably 1 to 4% of molybdenum.

The overbased additives according to the invention are completely soluble in hydrocarbons. They are incorporated in lubricant oils of natural or synthetic origin in a concentration of between 0.5 and 40% by weight and preferably between 1 and 30% by weight.

The lubricant compositions thus obtained can contain other additives, having an anti-wear, dispersant and antioxidant effect, and polymers which improve the viscosity index.

The examples below illustrate the invention without, however, restricting it.

In the examples the basicity of these overbased additives is characterized by their alkali value (AV) expressed in mg of KOH per gram of product. It is determined by titration with the aid of a strong acid in accordance with the standard ASTM D-2896.

Unless indicated otherwise, all of the percentages are by weight.

EXAMPLE A: Dinoram C/molybdenum complex

A solution of 41.17 g of sodium molybdate $Na_2MoO_4 \cdot 2H_2O$ in 100 ml of water is prepared in a reactor fitted with a temperature control and a stirrer device. The mixture is acidified by adding 55.6 g of 30% $H_2SO_4$ and then heated to 60° C. This is followed by the addition of 21 g of Dinoram C from CECA SA.

Dinoram C corresponds to the formula R—N-H—$(CH_2)_3$—$NH_2$, where R is a mixture of straight-chain saturated alkyl radicals containing 60% of $C_{12}$, 20% of $C_{14}$, 10% of $C_{16}$ and 5% of $C_{18}$.

The blue precipitate is recovered by filtering off and then washed with water and with methanol before drying.

Finally, 47.1 g of blue solid containing 32.6% of molybdenum and 4.4% of nitrogen are recovered.

EXAMPLE B: Dinoram C/molybdenum complex

The procedure is as in Example A, but the addition of Dinoram C is made at 60° C. before heating and before the acidification.

The pale blue solid recovered contains 34.1% of molybdenum, 0.3% of sodium and 4.46% of nitrogen.

EXAMPLE C: Sulphurization of the Dinoram C/molybdenum complex

A dispersion of 20 g of the complex prepared in Example A in 200 ml of xylene is prepared in a 250 ml reactor fitted with a temperature control, a stirrer and a gas bubbling system. 6.7 g of $H_2S$ are injected into the dispersion kept at 80° C.; the deep red solid collected after removal of the solvent contains 28.4% of molybdenum, 3.8% of nitrogen and 23.7% of sulphur.

EXAMPLE D: Dinoram O/molybdenum complex

The procedure is as in Example B, but 9.68 g of sodium molybdate are used in 35 ml of water. 4.8 g of Dinoram O (PM 270) from CECA SA are added at 65° C. before heating the mixture for 1 hour at 60° C.

Dinoram O is an N-alkylpropylenediamine. The alkyl radical corresponds to a mixture containing 80% of oleyl radical. The progressive formation of a white solid is then observed, which solid turns blue during the acidification. After washing and drying, 8.85 g of a blue solid containing 23% of molybdenum are recovered.

EXAMPLE E: Noram C/molybdenum complex

The procedure is as in Example B, but 7 g of Noram C primary monoamine from CECA SA are used. Noram C is a monoamine R—$NH_2$, where R is a mixture of straight-chain saturated alkyl radicals containing 60% of $C_{12}$, 20% of $C_{14}$, 10% of $C_{16}$ and 5% of $C_{18}$. Finally, 11 g of a light blue solid containing 26.7% of molybdenum are recovered.

EXAMPLE F: Stearylamine/molybdenum complex

The procedure is as in Example D, but 6.74 g of stearylamine from CECA SA are used.

7.68 g of a pale blue solid containing 20.5% of molybdenum and 3.4% of nitrogen are recovered.

EXAMPLE G: Primene 81-R/molybdenum complex

The procedure is as in Example D, but 8 g of Primene 81-R from ROHM and HAAS (PM 185 to 213) are used.

Primene 81-R is a mixture of two monoamines, 1-amino-1,1-dimethyldecane and 1-amino-1,1-dimethyldodecane. 15.75 g of a pasty blue product containing 12.5% of molybdenum are collected.

EXAMPLE H: 2-Ethylhexylamine/molybdenum complex

The procedure is as in Example B, but 9.9 g of 98% 2-ethylhexylamine are introduced in the course of 20 minutes into an aqueous solution containing 15.44 g of sodium molybdate and kept at 60° C. After heating at 60° C. for 45 minutes, the mixture is acidified with 23.1 g of 30% sulphuric acid, before washing and drying the product. The latter is in the form of a white solid containing 36.8% of molybdenum and 4.38% of nitrogen.

EXAMPLE I: p-Dodecylaniline/molybdenum complex

The procedure is as in Example A, but an aqueous solution containing 48.4 g of sodium molybdate is acidified with 65.4 g of 30% sulphuric acid. While the solution is kept at 60° C., 52.2 g of p-dodecylaniline are added.

The blue-green pasty solid is dissolved in xylene in order to remove the water by azeotropic distillation.

After removal of the solvent, 80 g of pasty solid containing 11.5% of molybdenum and 3.41% of nitrogen are recovered.

It may be pointed out that the complexes prepared in Examples A to I are virtually insoluble in hydrocarbon compounds and, moreover, in water or alcohols.

Their incorporation in the overbased additives is therefore not effected by dissolving in the hydrocarbon phase but by incorporation of the complex in the colloidal carbonate particles.

EXAMPLE 1: (comparative)

The following are introduced successively into a 1 liter reactor fitted with a temperature control, a condenser, a stirrer system and a gas bubbling device:

520 ml of toluene, 131.8 g of alkylxylenesulphonic acid having a $C_{16}$–$C_{18}$ straight-chain alkyl chain and a molecular weight of 430 and containing 96% of active substance, 168 g of diluent oil 100 Neutral solvent, 113.24 g of slaked lime of 96% purity and 48 ml of methanol.

After neutralization of the sulphonic acid with the lime, which if appropriate can be carried out by heating the reaction mixture at 60° C. for 30 minutes, 55.2 g of carbon dioxide gas are then introduced into the mixture which is kept at a temperature of 42° C.

After carbonation, the methanol and the water produced by the reaction are removed by heating the mixture under a partial vacuum. The mixture is clarified by filtration using 2% by weight of Diatomees Clarcel DICS from CECA SA.

After removing the solvent, 400 g of product containing 13.1% of calcium are recovered.

AV=321. The product is clear brown and is stable on dilution in mineral or synthetic oils. No turbidity and no settling are observed after several weeks at 60° C.

EXAMPLE 2: comparative

The procedure is as in Example 1, but 219.2 g of alkylarylsulphonic acid having a branched alkyl chain (of didodecylbenzenesulphonic acid), the molecular weight of which is 520 and which contains 70% of active substance, are introduced.

The amount of diluent oil is 108 g.

The product is in the form of a brown liquid with an AV of 304. It is stable on dilution in lubricant oils.

EXAMPLE 3:

The procedure is as in Example 1, but 30 g of the Dinoram C/molybdenum complex described in Example A are dispersed in 520 ml of xylene before the introduction of the other reactants. After carbonation and removal of water and methanol, the solid residues are removed by centrifuging. After evaporating off the solvent, 448 g of molybdenum-containing superbasic sulphonate are recovered; AV=300, its calcium content is 11.7% and its molybdenum content 2.17%. It is stable on dilution in lubricant oils.

EXAMPLE 4

The procedure is as in Example 1, but 28 g of the complex prepared in Example B are introduced into 520 ml of toluene before the addition of the other reactants.

A molybdenum-containing superbasic sulphonate is recovered. AV=303, the calcium content is 11.9% and the molybdenum content 1.94%. It is stable on dilution in oils.

EXAMPLE 5

The procedure is as in Example 2, but 28 g of the complex prepared in Example A are introduced into 520 ml of xylene. After carbonation, removal of water and methanol, recovery of the solid residues by centrifuging and then evaporation of the solvent, 440 g of product with an AV of 290 and containing 1.69% of molybdenum and 11.5% of calcium are collected. The stability on dilution in oil is remarkable.

EXAMPLE 6

The procedure is as in Example 1, but 28 g of sulphurized Dinoram C/molybdenum complex as described in Example C are suspended in 520 ml of xylene, this being carried out before the introduction of the other reactants. The sequence of operations is identical to that of Example 1 except that the residues are removed by centrifuging. A molybdenum-containing superbasic sulphonate is collected; AV=304. The molybdenum, sulphur and calcium contents are, respectively, 1.63, 3.4 and 11.7%. The product obtained has a brown-red colour and it is stable on dilution in lubricant oils.

EXAMPLE 7

The procedure is as in Example 1, but 28 g of the complex prepared in Example H are suspended in 520 ml of xylene before the introduction of the other reactants. The procedure is the same as in Example 1 except that the residues are removed by centrifuging. A brown product of AV=353 is collected. The calcium and molybdenum contents are, respectively, 12.2 and 1.97%. The stability on dilution in lubricant oils is perfect.

EXAMPLE 8

The procedure is as in Example 1, but 32 g of the complex prepared in Example I are introduced into 520 ml of xylene, before the other reactants. The procedure is identical to that of Example 1 except that the residues are removed by centrifuging. The molybdenum-containing overbased sulphonate is deep brown and stable in oils; AV=311; its calcium and molybdenum contents are, respectively, 11.9 and 1.09%.

EXAMPLE 9

The procedure is as in Example 1, but 30 g of the complex prepared in Example A are introduced into 520 ml of toluene before the addition of the other reactants. The sequence of operations is identical to that of Example 1 except that 52.7 g of $CO_2$ are introduced during the carbonation. After centrifuging, 448 g of molybdenum-containing superbasic sulphonate are recovered. AV=298. The calcium and molybdenum contents are, respectively, 11.7% and 2.1%. The stability in oils is remarkable.

EXAMPLE 10

The procedure is as in Example 9, but after filtration on diatomaceous earth, 440 g of molybdenum-containing containing overbased sulphonate of AV=292 are recovered. The molybdenum content is 1.96% and the product is clear and stable on dilution in oils.

EXAMPLE 11

The procedure is as in Example 1, but 600 ml of xylene, 132 g of didodecylbenzenesulphonic acid having a molecular weight of 520 and containing 70% of active substance, 30 g of the complex prepared in Example A, 104 g of slaked lime, 52 ml of methanol, 4.4 ml of ammonia and 90 g of diluent oil are introduced successively into the reactor.

The product collected is brown, clear and stable in oils. The calcium and molybdenum contents are, respectively, 10 and 2.35%.

EXAMPLE 12 (comparative)

77.8 g of dodecylphenol and 20 g of sulphur chloride are introduced at a temperature of 20°-30° C. into a 250 ml reactor fitted with a condenser, a temperature control and a gas bubbling device. While bubbling in nitrogen and while stirring, the mixture is heated for 1 hour at 150° C., then for 1 hour at 160° C. and finally for 1 hour at 200° C. Sulphurized dodecylphenol, the respective chlorine and sulphur contents of which are 2200 ppm and 11.4%, is collected.

43 g of sulphurized dodecylphenol, 30 g of diluent oil 100 Neutral solvent, 90 ml of xylene, 11.8 g of calcium oxide, 66 ml of methanol and 2 g of calcium nitrate $Ca(NO_3)_2.4H_2O$ are introduced successively into another 250 ml reactor fitted with a stirrer system, a temperature control and a gas bubbling device. The mixture is refluxed for 45 minutes before removing the water produced by the neutralization. 66 ml of methanol are added to the mixture before carbonating the stoichiometric excess of lime with carbon dioxide gas, at a temperature of 50° C. After carbonation, the residual water and the methanol are removed by heating under a partial vacuum, before recovering the solid residues by filtration.

After evaporating off the solvent, a overbased sulphurized dodecylphenol of brown-green colour is collected which is stable in oils. AV=240.

EXAMPLE 13

The procedure is as in Example 12, but 5.6 g of the amine/molybdenum complex prepared in Example B are introduced into the reaction mixture just after the removal of the water of neutralization. A overbased phenolate of AV=243 is recovered, the molybdenum content of which is 1.89%. The product is stable on dilution in oil.

EXAMPLE 14 (comparative)

The procedure is as in Example 1, but 312 g of ($C_{14}C_{18}$-alkyl)salicylic acid, 37.5 g of slaked lime, 150 ml of methanol and 100 g of diluent oil are introduced into the reactor. After neutralization and carbonation at 42° C. with 7.65 g of $CO_2$, 30 g of lime are added, which are carbonated with 10 g of $CO_2$. An additive of deep brown colour which is stable in oils is collected. Its calcium content is 7.6%; AV=205.

EXAMPLE 15

The procedure is as in Example 14, but 27 g the complex prepared in Example B are introduced before the lime. The product collected at the end of the operations is deep brown and stable in oils. AV=197; its molybdenum content is 1.77%.

EXAMPLE 16

The performances of the new overbased detergents containing molybdenum are examined in laboratory wear, friction and oxidation tests. The test matrices correspond to lubricants for land engines on the one hand and for marine engines on the other hand.

First of all the products are tested in a lubricant formulation used in petrol engines (ELF Presti 15 W 40) with simple replacement of the overbased detergent.

The samples contain 1.25% of superbasic detergent.

WEAR AND FRICTION TEST (lubricant for petrol engines)

Falex test: (according to the standard ASTM 2670).

The test is carried out under the following conditions:

Grinding for 5 minutes under 200 lbs (normal load)

3 hours under 540 lbs (normal load)

At the end of the test, the frictional torque, the wear in number of teeth of the ratchet wheel and the temperature of the oil bath tested are noted. (The wear is the less the lower the number of teeth, the frictional torque and the temperature). It can be seen from Table 1 that the overbased sulphonates containing an amine-molybdenum complex enable the frictional torque to be reduced by on average 50 to 70%. The use of a conventional friction-reducing agent containing molybdenum, in combination with a reference sulphonate, gives a catastrophic result (Example 1+1.2% MOLYVAN L), although the molybdenum content in the latter case is of the order of 1200 ppm compared with 250 ppm for the oils formulated with the molybdenum-containing overbased sulphonates according to the invention.

TABLE 1

| Product from Example 1 (1.25%) | Wear in number of teeth | Frictional torque N × cm | Oil temperature °C. |
|---|---|---|---|
| 1 (comparative) | 24 | 164 | 161 |
| 4 | 34 | 81 | 87 |
| 9 | 33 | 63 | 94 |
| 6 | 28 | 102 | 111 |
| 7 | 38 | 84 | 94 |
| 10 | 35 | 51 | 92 |
| 2 (comparative) | 27 | 178 | 143 |
| 5 | 30 | 84 | 108 |
| 1 (comparative) + 1.2% MOLYVAN L | fracture in 1h30 | 190 in 1h30 | |

A substantial reduction in the heating, associated with the reduction in friction effected by the overbased sulphonates according to the invention, is also observed.

| 4-ball machine (according to the standard ASTM 2783-71) The test conditions are as follows | |
|---|---|
| speed: | 1500 rev/minutes |
| time: | 1 hour |
| charge: | 60 kg |

Table 2 gives the results obtained after oxidation of the lubricant for 24 hours at 160° C. under an oxygen flow of 15 1/hour. The quotation is obtained by determining the imprint diameter.

TABLE 2

| Product from Example | Imprint diameter in mm |
|---|---|
| 2 (comparative) | 1.53 |
| 5 | 0.28 |
| 11 | 0.79 |

The beneficial effect of the use of molybdenum-containing additives on the anti-wear performance of the lubricant after oxidation is observed.

OXIDATION TEST (TFOUT)

The TFOUT (thin film oxygen uptake test) test is carried out on the same petrol formulations. It is carried out at 160° C. in a pressurized oxygen cylinder (90 psi) in the presence of metal catalyst (naphthenate of Pb, Cu, Fe, Mn and Sn), water and oxidized nitro petrol so as to simulate, in part, the conditions to which the oil can be subjected in a petrol engine.

Table 3 gives the values for the induction time, that is to say the time between the start of the test and the start of the rapid drop in pressure in the cylinder.

The increase in the induction time is significant in the presence of the additive containing the molybdenum-amine complex.

TABLE 3

| Product from Example | Induction time in min |
|---|---|
| 1 comparative | 135 |
| 4 | 150 |
| 9 | 153 |
| 2 comparative | 137 |
| 5 | 159 |

The overbased detergents containing molybdenum are then tested in a lubricant formulation for a marine engine (cylinder oil).

The basicity of the oil is 70 mg KOH/g, of which only 20 mg KOH/g are contributed by the overbased detergent.

The oil also contains 0.5% of DTPZ.

WEAR AND FRICTION TEST (lubricants for marine engines)

Falex test:

Conditions: Grinding 5 minutes under 300 lbs, 3 hours, Charge 700 lbs. (normal load)

These conditions are close to extreme pressure.

It can be seen from Table 4 that the cylinder oil for marine engines formulated with the overbased detergents according to the invention enables the wear on the Falex machine to be significantly reduced or even completely suppressed.

TABLE 4

| Products from Example | DTPZ in % | Wear in mg |
|---|---|---|
| 1 (comparative) | 0 | 163 |
| 1 (comparative) | 0.5 | 180 |
| 4 | 0 | 115 |
| 4 | 0.5 | 73 |
| 9 | 0 | 1 |
| 9 | 0.5 | 7 |
| 10 | 0.5 | 18 |

We claim:

1. An overbased additive for lubricant oils, comprising a composition formed by carbonation of a mixture comprising: at least one detergent or detergent precursor, at least one compound selected from the group consisting of alkali metal oxide, alkali metal hydroxide, alkali metal alcoholate, alkaline earth metal oxide, alkaline earth metal hydroxide and alkaline earth metal alcoholate and at least one hydrocarbon insoluble organic molybdenum complex.

2. An additive according to claim 1, wherein said additive contain 0.1 to 10% by weight of molybdenum.

3. An additive according to claim 1, wherein said additive contain 1 to 4% of molybdenum.

4. An additive according to claim 1 or 2, wherein the organic molybdenum complex is formed with an amine.

5. An additive according to claim 1 or 2, wherein the molybdenum complex is prepared by reaction of an inorganic molybdenum compound having an acid reaction with an amine.

6. An additive according to claim 5, wherein the inorganic molybdenum compound comprises at least one compound selected from the group consisting of molybdic acid, alkali metal molybdate, sodium hydrogen molybdate, ammonium molybdate, $MoOCl_4$, $MoO_2Br_2$, $Mo_2O_3Cl_6$ or molybdenum trioxide.

7. An additive according to claim 5, wherein the amine comprises a primary, secondary or tertiary aliphatic amine.

8. An additive according to claim 6, wherein the amine is a primary amine, selected from the group consisting of oleylamine, stearylamine, dodecylamine, tert-dodecylamine, 2-ethylhexylamine, cyclohexylamine, 1-amino-1,1-dimethyldecane and 1-amino-1,1-dimethyldodecane.

9. An additive according to claim 6, wherein the amine is a secondary amine in which the total number of carbons does not exceed 12.

10. An additive according to claim 5, wherein the amine is an aromatic amine.

11. An additive according to claim 5, wherein the amine is para-dodecylaniline.

12. An additive according to claim 5, wherein the amine is a diamine having a primary amine group.

13. An additive according to claim 12, wherein the diamine corresponds to the formula $R_1R_2N—(CH_2)n—NH_2$ (I) where $R_1$ and $R_2$ are identical or different and represents hydrogen or a straight-chain or branched, saturated or unsaturated $C_1$ to $C_{30}$, aliphatic radical, wherein at least one of the radicals $R_1$ or $R_2$ represents an aliphatic radical and n is a number between 1 and 8.

14. An additive according to claim 13, wherein the diamine corresponds to the general formula $R_1R_2N—(CH_2)n—NH_2$ (I) where $R_1$ and $R_2$ are identical or different and represent hydrogen or a straight-chain or branched, saturated or unsaturated $C_8$ to $C_{20}$, aliphatic radical, wherein at least one of the radicals $R_1$ and $R_2$ represent an aliphatic radical and n is a number between 2 and 4.

15. An additive according to claim 14, wherein in the general formula (I), $R_1$ is hydrogen and $R_2$ is a saturated or unsaturated radical originating from fatty acids or mixtures of fatty acids.

16. An additive according to claim 15, wherein $R_2$ comprises a $C_{12}$ to $C_{18}$ saturated or unsaturated alkyl radical.

17. An additive according to claim 4 wherein the atomic ratio of nitrogen to molybdenum in the complex is between 0.25 and 4 and its molybdenum content is between 10 and 45% by weight.

18. An additive according to claim 4, when the amine-molybdenum complex is prepared by the addition of the amine to an aqueous solution of the inorganic molybdenum compound, at a temperature of from 20°to 100° C., for 0.5 to 3 hours after the addition of the amine.

19. An additive according to claim 4, wherein the amine-molybdenum complex is prepared by the addition of an amine to an aqueous solution of the inorganic molybdenum compound to form a mixture, the temperature being kept between 50°and 90° C., for 0.5 to 3 hours after the addition of the amine.

20. An additive according to claim 19, wherein the mixture is neutralized by the addition of sulphuric acid.

21. An additive according to claim 19, wherein the mixture is neutralized by the addition of a strong mineral acid.

22. An additive according to claim 1 or 2, wherein the organic molybdenum complex is formed with an oxygen-containing compound.

23. An additive according to claim 22, wherein the oxygen-containing compound is an alkoxylated amine or alkoxylated polyamine.

24. An additive according to claim 23, wherein the amine or polyamine comprises alkoxylated with ethylene oxide or propylene oxide.

25. An additive according to claim 23, wherein the alkoxylated amine or polyamine comprises an alkoxylated derivative of diethanolamine or of triethanolamine.

26. An additive according to claim 22, wherein the oxygen-containing compound comprises a 1,2-, 1,3- or 1,4-glycol.

27. An additive according to claim 22, wherein the oxygen-containing compound comprises ethylene glycol or propylene glycol.

28. An additive according to claim 22, wherein the oxygen-containing compound is a polyol.

29. An additive according to claim 22, wherein the oxygen-containing compound is glycerol or trimethylolpropane.

30. An additive according to claim 22, wherein the organic molybdenum complex contains between 7 to 50% by weight of molybdenum.

31. An additive according to claim 1, wherein the organic molybdenum complex is a sulphurized complex.

32. An additive according to claim 31, wherein the complex is sulphurized by hydrogen sulphide.

33. A process for the preparation of an overbased additive according to claim 30 comprising carbonation of a mixture containing a detergent or a detergent precursor, an alkali metal or alkaline earth metal derivative, a promoter, at least one or more of a hydrocarbon solvent, a diluent oil and water, and at least one hydrocarbon insoluble organic molybdenum complex.

34. A process according to claim 33, wherein the detergent is selected from the group consisting of alkali metal or alkaline earth metal sulphonates, phenolates, naphthenates, salicylates, phosphonates and thiophosphonates.

35. A lubricant composition containing a lubricant oil of natural or synthetic origin and 0.5 to 40% by weight, of an additive of claim 1.

36. A composition according to claim 35, comprising additives having an anti-wear, dispersant or antioxidant effect and polymers which improve the viscosity.

* * * * *